US006982688B2

(12) United States Patent
Ochi et al.

(10) Patent No.: US 6,982,688 B2
(45) Date of Patent: Jan. 3, 2006

(54) DRIVING APPARATUS FOR CAPACITIVE LIGHT EMITTING ELEMENT DISPLAY PANEL

(75) Inventors: Hideo Ochi, Tsurugashima (JP); Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 244 days.

(21) Appl. No.: 10/206,948

(22) Filed: Jul. 30, 2002

(65) Prior Publication Data

US 2003/0025655 A1 Feb. 6, 2003

(30) Foreign Application Priority Data

Aug. 3, 2001 (JP) ..... 2001-236619

(51) Int. Cl.
*G09G 3/34* (2006.01)

(52) U.S. Cl. ..... 345/82; 345/211

(58) Field of Classification Search .. 315/169.1–169.4; 345/26, 87, 100, 208, 211, 213, 212, 82
See application file for complete search history.

(56) References Cited

U.S. PATENT DOCUMENTS 4,864,182 A * 9/1989 Fujioka et al. ..... 315/169.3
4,935,671 A * 6/1990 Harada et al. ..... 315/169.3

* cited by examiner

*Primary Examiner*—Kent Chang
(74) *Attorney, Agent, or Firm*—Sughrue Mion, PLLC

(57) ABSTRACT

A driving apparatus for a capacitive light emitting element display panel which comprises a driving apparatus for supplying a first predetermined potential to one selected scanning line, supplying a second predetermined potential higher than the first predetermined potential to scanning lines other than the one scanning line, supplying a driving current to a light emission drive line corresponding to a capacitive light emitting element driven to emit light, and supplying a third predetermined potential higher than the first predetermined potential and lower than a light emission threshold voltage to drive lines other than the light emission drive line, wherein the third predetermined potential is generated from a current discharge terminal of a voltage source connected to a predetermined load circuit for supplying a power supply voltage to the predetermined load circuit.

7 Claims, 12 Drawing Sheets

DRIVING APPARATUS FOR CAPACITIVE LIGHT EMITTING ELEMENT DISPLAY PANEL

BACKGROUND OF THE INVENTION

1. Field of the Invention

The present invention relates to a driving apparatus for a display panel which uses capacitive light emitting elements such as organic electroluminescence elements.

2. Description of the Related Background Art

An organic electroluminescence element (hereinafter simply called the EL element), which is one of capacitive light emitting elements, can be electrically represented by an equivalent circuit as shown in FIG. 1. As understood from FIG. 1, the EL element can be replaced by a configuration of a capacitive component C, and a component E having a diode characteristic coupled in parallel with the capacitive component. Therefore, the EL element can be regarded as a capacitive light emitting element. As a direct current light emission driving voltage is applied between electrodes, a charge is accumulated on the capacitive component C, and as it subsequently exceeds a barrier voltage or a light emission threshold voltage inherent to the element, a current begins flowing from an electrode (anode side of the diode component E) to an organic functional layer carrying a light emitting layer, causing the EL element to emit light at an intensity proportional to the current.

The voltage V—current I—luminance L characteristic of the EL element is similar to the characteristic of a diode, as shown in FIG. 2, where the current I is extremely small at a voltage equal to or lower than the light emission threshold voltage Vth, and the current I suddenly increases at a voltage equal to or higher than the light emission threshold voltage Vth. Also, the current I substantially proportional to the luminance L. Such an element presents a light emission luminance proportional to a current in accordance with a driving voltage when the element is applied with the driving voltage exceeding the light emission threshold voltage Vth, and no driving current flows if the applied driving voltage is equal to or lower than the light emission threshold voltage Vth, causing the light emission luminance to remain equal to zero.

A simple matrix display panel which has a plurality of EL elements arranged in matrix is known. FIG. 3 shows a simple matrix display panel 1 and a driving apparatus for driving the display panel 1. The display panel 1 shows a total of 16 EL elements $E_{1,1}$–$E_{4,4}$, four in the horizontal direction and four in the vertical direction, for simplifying explanation. Each of the EL elements $E_{1,1}$–$E_{4,4}$ forms a pixel of the display panel 1. In FIG. 3, each of the EL elements $E_{1,1}$–$E_{4,4}$ is represented by a symbol of a diode. The EL elements $E_{1,1}$–$E_{4,4}$ are arranged at portions at which four anode lines (drive lines) $A_1$–$A_4$ arranged in parallel in the vertical direction intersect with four cathode lines (scanning lines) $B_1$–$B_4$ arranged in parallel in the horizontal direction. An anode electrode of each of the EL elements $E_{1,1}$–$E_{4,4}$ is connected to a corresponding anode line $A_1$–$A_4$, while a cathode electrode is connected to a corresponding cathode line $B_1$–$B_4$.

The driving apparatus of the display panel 1 includes an anode driving circuit 2 and a cathode scanning circuit 3. The anode driving circuit 2 has current sources $\mathbf{4}_1$–$\mathbf{4}_4$ and change-over switches $\mathbf{5}_1$–$\mathbf{5}_4$ corresponding to the anode lines $A_1$–$A_4$. Input terminals of the current sources $\mathbf{4}_1$–$\mathbf{4}_4$ are connected to a positive terminal of a power supply 7 for outputting a voltage VA (for example, 24 V). Current output terminals of the current sources $\mathbf{4}_1$–$\mathbf{4}_4$ are each connected to one fixed contact of a change-over switch $\mathbf{5}_1$–$\mathbf{5}_4$ corresponding thereto. The other fixed contacts of the change-over switches $\mathbf{5}_1$–$\mathbf{5}_4$ are connected to a ground. Movable contacts of the change-over switches $\mathbf{5}_1$–$\mathbf{5}_4$ are connected to corresponding anode lines $A_1$–$A_4$. Switching operations of the change-over switches $\mathbf{5}_1$–$\mathbf{5}_4$ are controlled by a control circuit 9 in accordance with an image signal.

The cathode scanning circuit 3 has change-over switches $\mathbf{6}_1$–$\mathbf{6}_4$. One fixed contact of the change-over switch $\mathbf{6}_1$–$\mathbf{6}_4$ is connected to a positive terminal of the power supply for outputting a voltage VK (for example, 20 V), and the other fixed contacts are connected to the ground. Movable contacts of the change-over switches $\mathbf{6}_1$–$\mathbf{6}_4$ are connected to the corresponding cathode lines $B_1$–$B_4$. Switching operations of the change-over switches $\mathbf{6}_1$–$\mathbf{6}_4$ are sequentially performed by the control circuit 9. The control circuit 9 repeatedly supplies a selection signal to the change-over switches $\mathbf{6}_1$–$\mathbf{6}_4$ in that order in synchronism with a horizontal synchronization signal of an image signal. The movable contacts of the change-over switches $\mathbf{6}_1$–$\mathbf{6}_4$ are normally in contact with the one fixed contacts, and any one of the change-over switches $\mathbf{6}_1$–$\mathbf{6}_4$ supplied with the selection signal from the control circuit 9 switches to a contact to the other fixed contact. A ground potential (0 V) is applied to the cathode lines $B_1$–$B_4$ in order through the change-over switch selected by the selection signal, thus performing the scanning.

A current flows through the change-over switches $\mathbf{5}_1$–$\mathbf{5}_4$ into EL elements driven to emit light corresponding to an image signal within EL elements connected to a cathode line at the ground potential, i.e., a selected cathode line, so that the EL elements emit light.

FIG. 4 shows operating states of the change-over switches $\mathbf{5}_1$–$\mathbf{5}_4$ and $\mathbf{6}_1$–$\mathbf{6}_4$, and a current flow at the time the EL elements $E_{1,2}$ and $E_{3,2}$ begin emitting light. The change-over switches $\mathbf{5}_1$ and $\mathbf{5}_3$ connect the current sources $\mathbf{4}_1$ and $\mathbf{4}_3$ to the anode lines $A_1$ and $A_3$, and the change-over switches $\mathbf{5}_2$ and $\mathbf{5}_4$ apply the ground potential to the anode lines $A_2$ and $A_4$. The change-over switch $\mathbf{6}_2$ is selected to apply the ground potential to the cathode line $B_2$, and the remaining change-over switches $\mathbf{6}_1$, $\mathbf{6}_3$ and $\mathbf{6}_4$ apply the potential VK to the cathode lines $B_1$, $B_3$ and $B_4$.

In the state of FIG. 4, the current flows, as indicated by an arrow, from the current source $\mathbf{4}_1$ to the ground through the change-over switch $\mathbf{5}_1$, anode line $A_1$, EL element $E_{1,2}$, cathode line $B_2$ and change-over switch $\mathbf{6}_2$, causing the EL element $E_{1,2}$ to emit light. Similarly, the current flows from the current source $\mathbf{4}_3$ to the ground through the change-over switch $\mathbf{5}_3$, anode line $A_3$, EL element $E_{3,2}$, cathode line $B_2$ and change-over switch $\mathbf{6}_2$, causing the EL element $E_{3,2}$ to emit light.

Also, in the state of FIG. 4, the cathode electrodes of the EL elements $E_{1,1}$–$E_{4,1}$ are applied with the potential VK through the change-over switch $\mathbf{6}_1$ and cathode line $B_1$; the cathode electrodes of the EL elements $E_{1,3}$–$E_{4,3}$ are applied with the potential VK through the change-over switch $\mathbf{6}_3$ and cathode line $B_3$; and the cathode electrodes of the EL elements $E_{1,4}$–$E_{4,4}$ are applied with the potential VK through the change-over switch $\mathbf{6}_4$ and cathode line $B_4$. The anode lines $A_2$ and $A_4$ are driven to the ground potential through the change-over switches $\mathbf{5}_5$ and $\mathbf{5}_4$. Thus, the EL elements $E_{2,1}$, $E_{2,3}$, $E_{2,4}$, $E_{4,1}$, $E_{4,3}$ and $E_{4,4}$ indicated by black diode symbols in FIG. 4 are applied with the voltage VK in the reverse direction in polarity, resulting in a so-called backward biased state. Currents flows through the EL elements $E_{2,1}$, $E_{2,3}$, $E_{2,4}$, $E_{4,1}$, $E_{4,3}$ and $E_{4,4}$ from the cathode electrode side to the anode electrode side, as indicated by arrows in FIG. 4, to charge them.

Upon termination of a light emitting period of the EL elements $E_{1,2}$ and $E_{3,2}$, the change-over switches $\mathbf{5}_1$ and $\mathbf{5}_3$ are switched, as shown in FIG. 5, to make the anode lines $A_1$ and $A_3$ equal to the ground potential. At this time, the change-over switch $\mathbf{6}_2$ still maintains the cathode line $B_2$ to be equal to the ground potential. Therefore, since the anode electrodes and cathode electrodes of the EL elements $E_{1,2}$, $E_{2,2}$, $E_{3,2}$ and $E_{4,2}$ are both at the ground potential, the EL elements $E_{1,2}$, $E_{3,2}$ stop emitting light. On the other hand, the EL elements $E_{1,1}$, $E_{1,3}$, $E_{1,4}$, $E_{3,1}$, $E_{3,3}$ and $E_{3,4}$ indicated by black diode symbols in FIG. 5 are applied with the voltage VK in the reverse direction in polarity, resulting in a so-called backward biased state. Currents flow through the EL elements $E_{2,1}$, $E_{2,3}$, $E_{2,4}$, $E_{4,1}$, $E_{4,3}$ and $E_{4,4}$ from the cathode electrode side to the anode electrode side, as indicated by arrows in FIG. 5, to charge them. FIG. 6 shows an example of a change in the current flowing into an EL element when it is charged. In FIG. 6, charging is started from time t=0.

Charges accumulated on EL elements except for the EL elements $E_{1,2}$, $E_{2,2}$, $E_{3,2}$ and $E_{4,2}$ by the charging are discharged by a reset operation, immediately before the selection signal is generated for the next scanning, which forcedly connects all the cathode lines $B_1$–$B_4$ to the ground and applies a predetermined potential to the anode lines $A_1$–$A_4$.

Such charging and discharging operations are similar when any one of other change-over switches $\mathbf{6}_1$, $\mathbf{6}_3$, $\mathbf{6}_4$ is selected by scanning to supply the ground potential to the cathode lines.

However, in the conventional driving apparatus, there is a problem that a charging current flows through EL elements which are connected to cathode lines other than the cathode line selected by the scanning as described above and are not related to light emission, so that power is consumed uselessly.

SUMMARY OF THE INVENTION

It is therefore an object of the present invention to provide a driving apparatus for a display panel which is capable of reducing useless power consumption by a charging current of capacitive light emitting elements.

According to the present invention, there is provided a driving apparatus for a display panel including a plurality of drive lines and a plurality of scanning lines intersecting with the plurality of drive lines, a plurality of capacitive light emitting elements connected between the scanning lines and the drive lines at each of a plurality of intersecting positions by the drive lines and the scanning lines and having polarities, the driving apparatus comprising: a controller for selecting one scanning line of the plurality of scanning lines in order at a predetermined timing to specify as a light emission drive line a drive line corresponding to a capacitive light emitting element driven to emit light on the one scanning line, of the plurality of drive lines; a scanning device for supplying the one scanning line with a first predetermined potential, and supplying scanning lines other than the one scanning lines of the plurality of scanning lines with a second predetermined potential higher than the first predetermined potential; and a driver for supplying the light emission drive line with a driving current to apply the capacitive light emitting element driven to emit light with a positive voltage equal to or higher than a light emission threshold voltage in a forward direction and supplying drive lines other than the light emission drive lines of the plurality of drive lines with a third predetermined potential higher than the first predetermined potential and lower than the light emission threshold voltage, wherein the third predetermined potential is generated from a current discharge terminal of a voltage source connected to a predetermined load circuit for supplying a power supply voltage to the predetermined load circuit.

DETAILED DESCRIPTION OF THE PREFERRED EMBODIMENTS

In the following, embodiments of the present invention will be described in detail with reference to the drawings.

Figure 1:
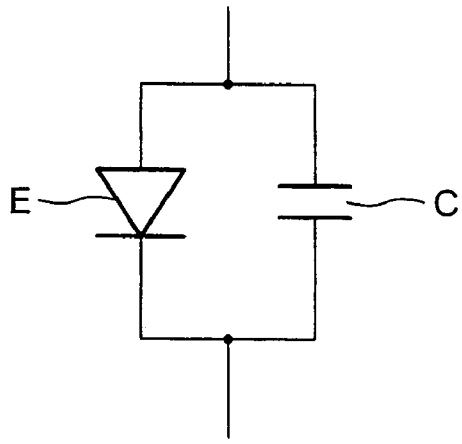
FIG. 1 PRIOR ART
FIG. 1 is a diagram showing an equivalent circuit of an EL element.
Figure 2:
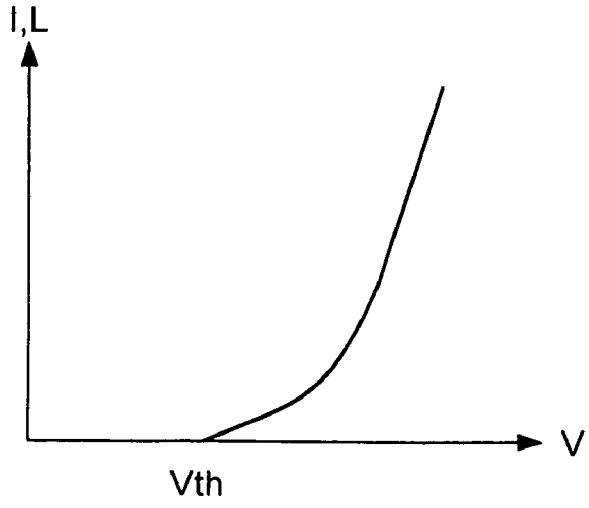
FIG. 2 PRIOR ART
FIG. 2 is a diagram generally showing the driving voltage—current—light emission luminance characteristic of the EL element.
Figure 3:
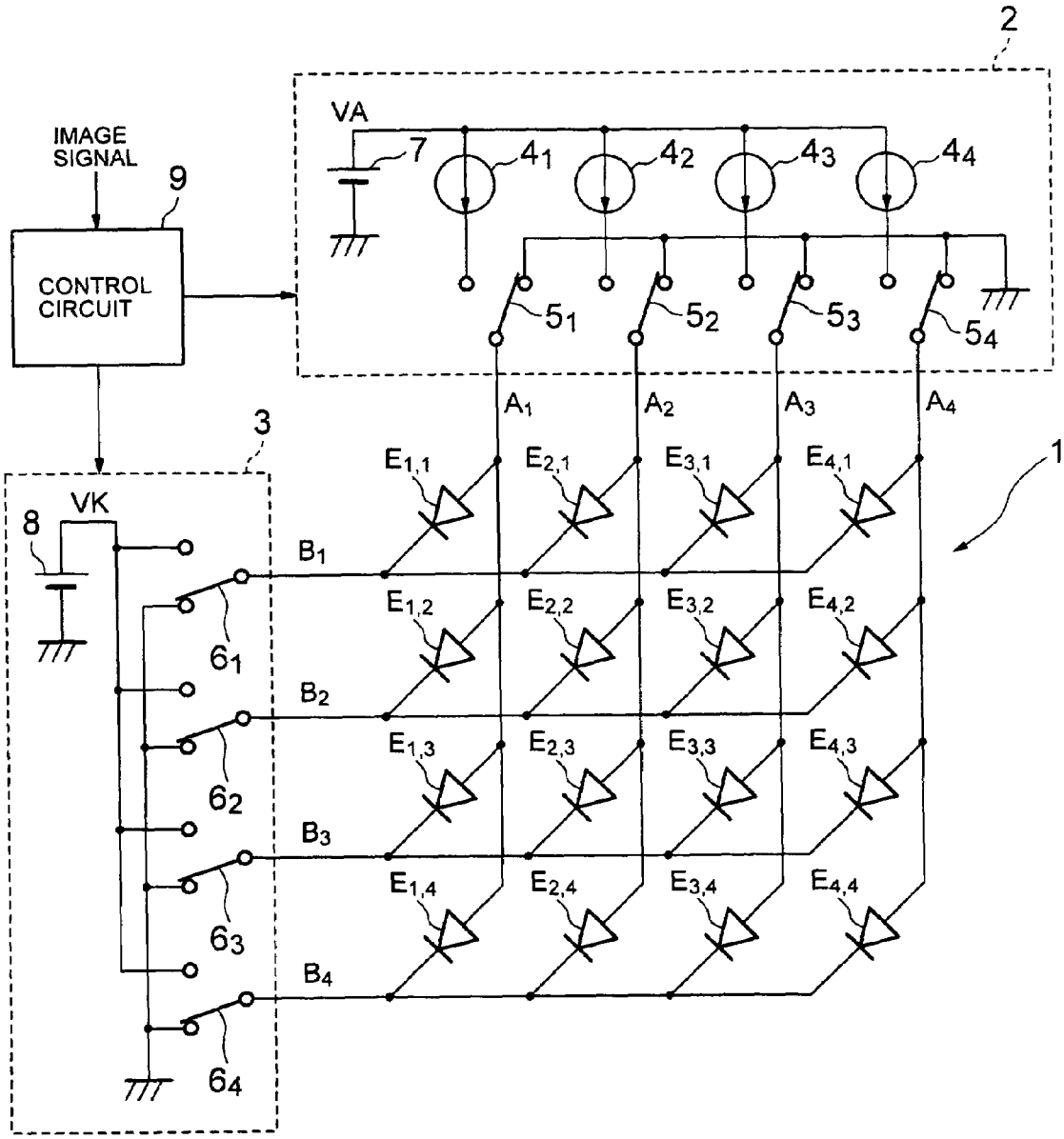
FIG. 3 PRIOR ART
FIG. 3 is a diagram showing the configuration of each of a display panel and a driving apparatus therefor.
Figure 4:
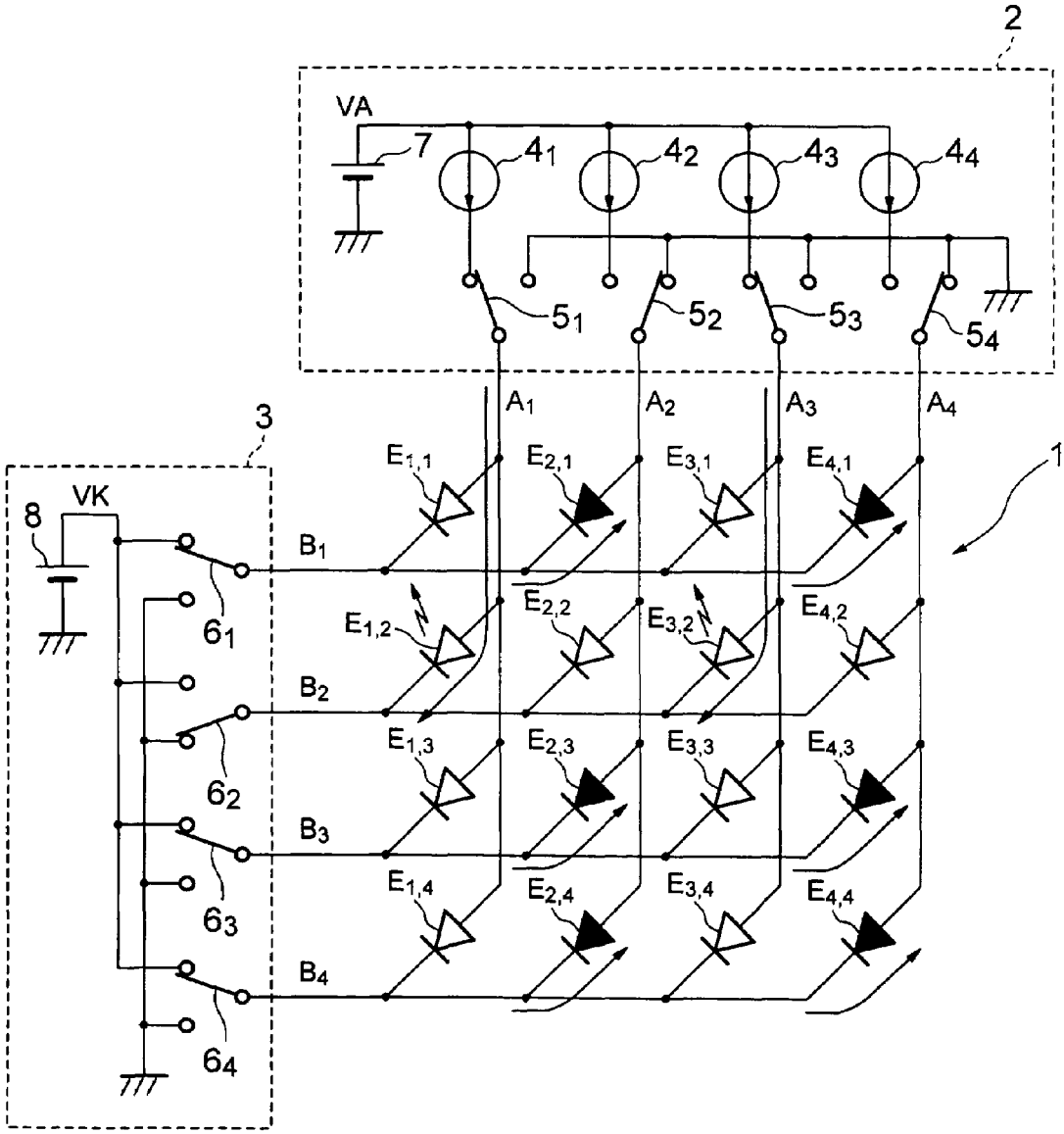
FIG. 4 PRIOR ART
FIG. 4 is a diagram showing the operating state of change-over switches and a current flow when EL elements start emitting light in the apparatus of FIG. 3.
Figure 5:
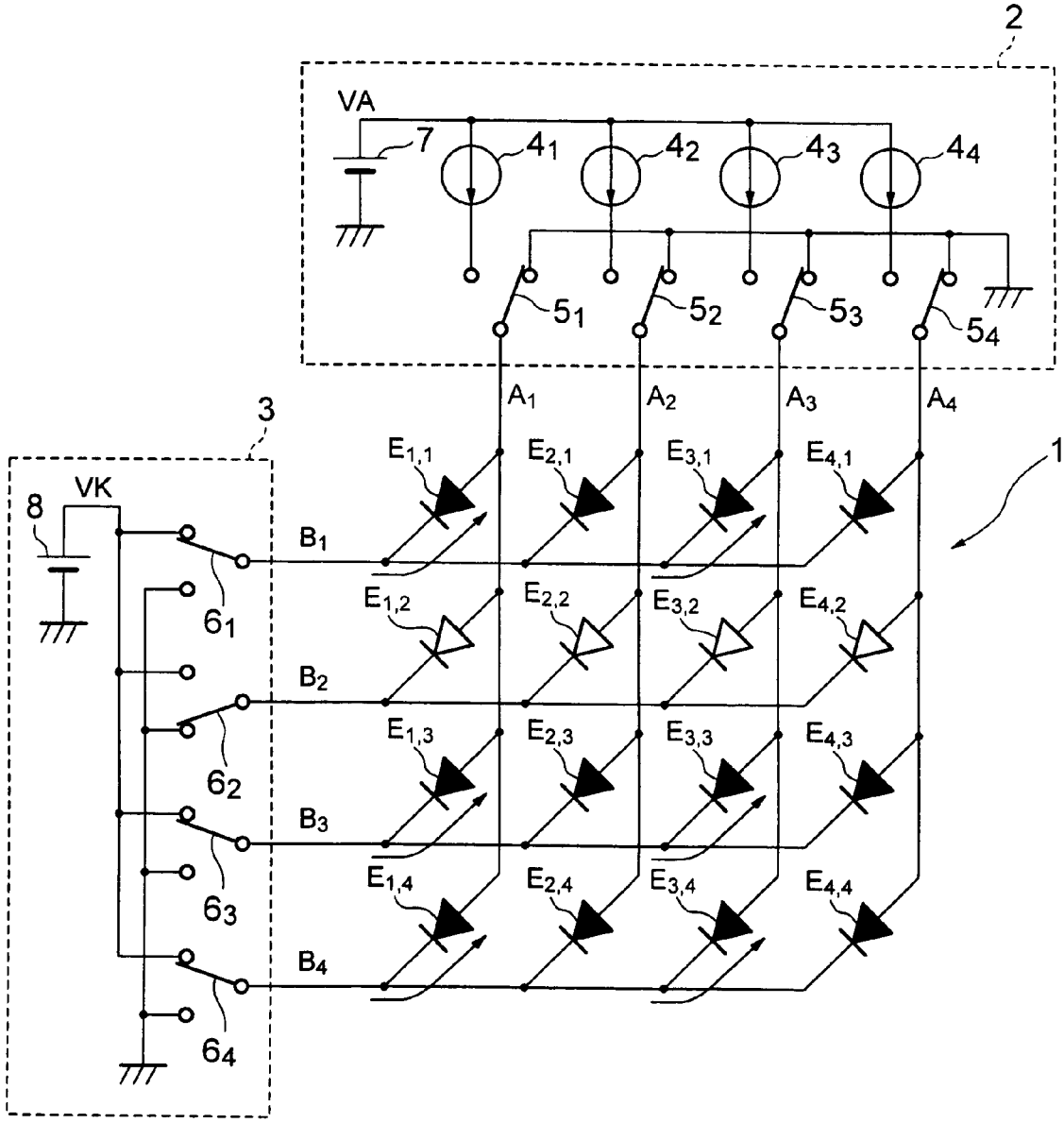
FIG. 5 PRIOR ART
FIG. 5 is a diagram showing the operating state of the change-over switches and a current flow when a light emitting period of the EL elements terminates in the apparatus of FIG. 3.
Figure 6:
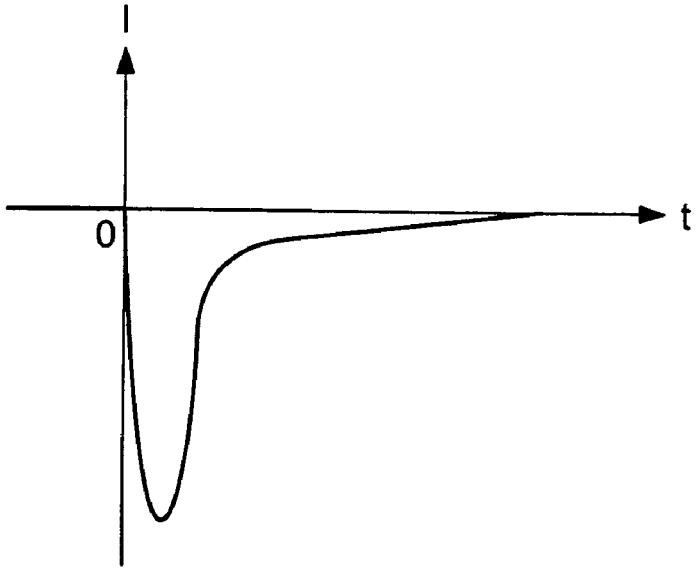
FIG. 6 PRIOR ART
FIG. 6 is a diagram showing a change in a current flowing into an EL element when it is charged.
Figure 7:
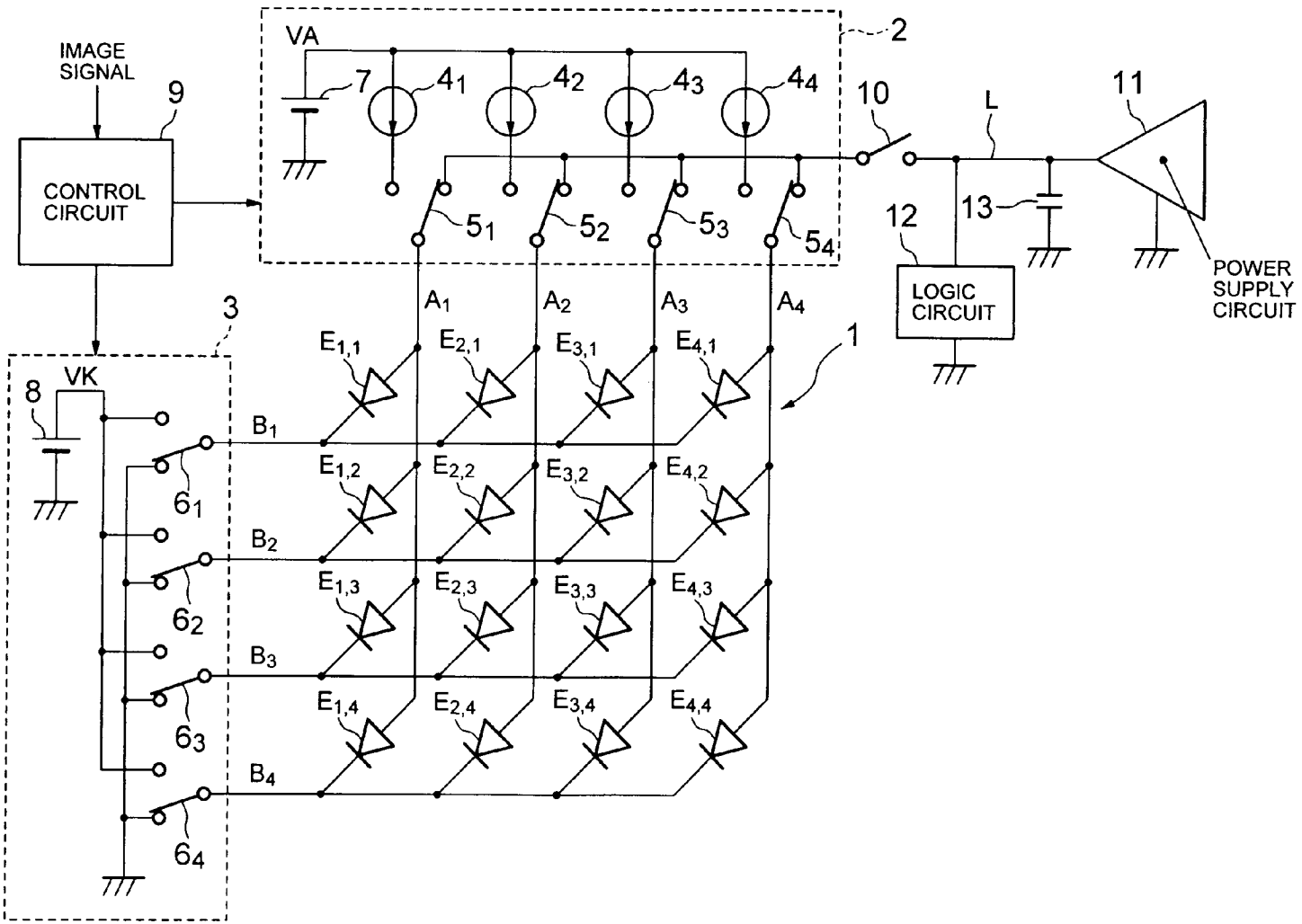
FIG. 7 is a diagram showing an embodiment of the present invention.

FIG. 7 shows a driving apparatus according to the present invention, wherein parts identical to those shown in FIG. 3 are designated the same reference numerals. Other fixed contacts of change-over switches $\mathbf{5}_1$–$\mathbf{5}_4$ are connected to a power supply circuit 11 and a logic circuit 12 through a switch 10. The power supply circuit 11 is a power supply circuit for the logic circuit 12, and is, for example, a current discharge type voltage source for outputting a low voltage VL such as 3 V (a voltage lower than a light emission threshold voltage Vth for emitting light from an EL element). The voltage VL is a voltage lower than the light emission threshold voltage Vth, and a voltage lower than a voltage VK. Between a connection line L connecting a current discharge terminal of the power supply circuit 11 and the logic circuit 12 and the ground, a capacitor 13 is connected for smoothing. The current discharge terminal is a terminal which provides the potential VL for sending out a current from the power supply circuit 11 to a load such as the logic circuit 12. The switch 10 is turned on when a display panel 1 is driven, but may be normally on. The capacitance of the capacitor 13 is sufficiently large as compared with the capacitance of the display panel 1.

The remaining configuration of the apparatus in FIG. 7 is similar to the configuration shown in FIG. 3.

Figure 8:
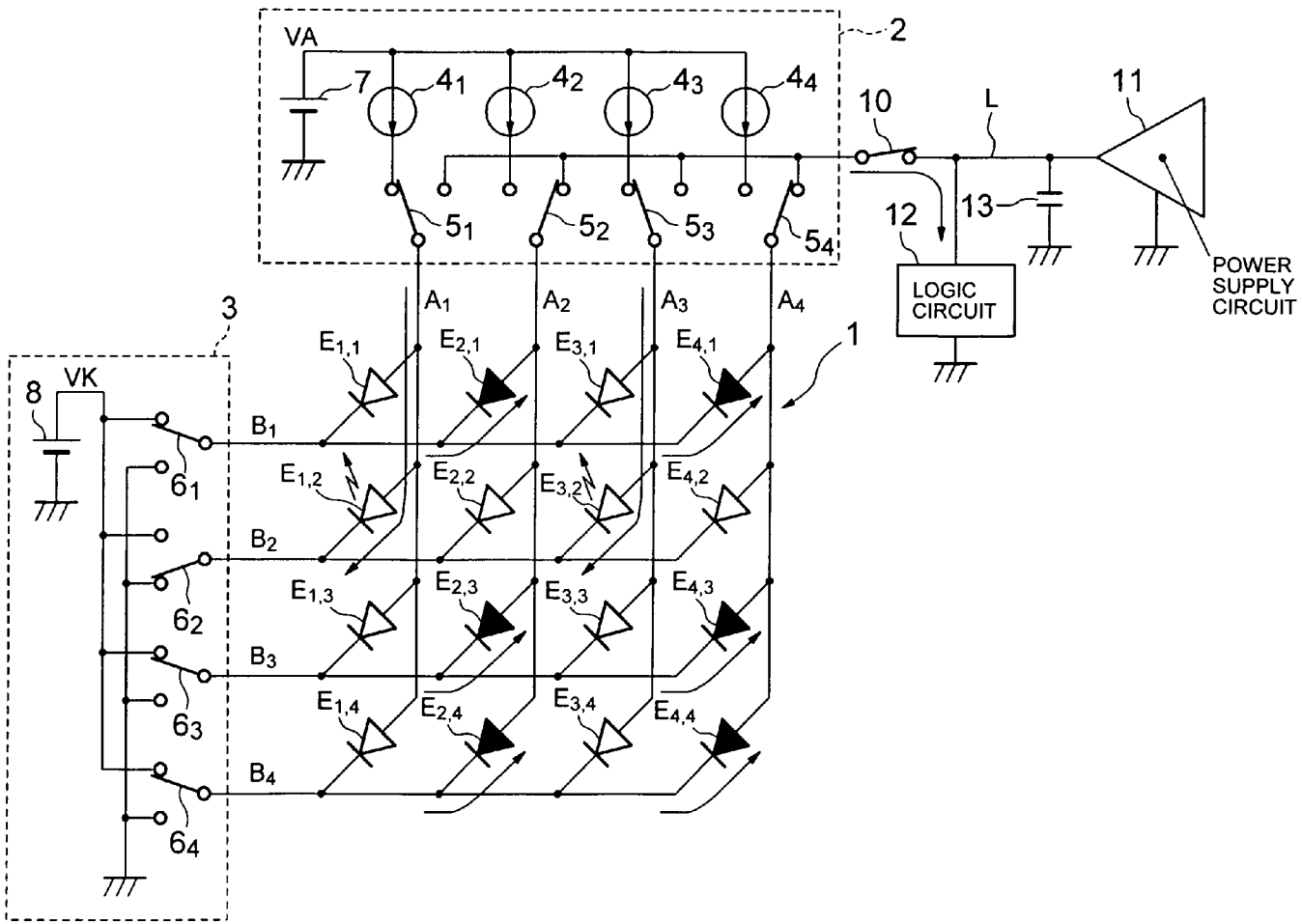
FIG. 8 is a diagram showing the operating state of change-over switches and a current flow when EL elements start emitting light in the apparatus of FIG. 7.

FIG. 8 shows operating states of the change-over switches $\mathbf{5}_1$–$\mathbf{5}_4$ and change-over switches $\mathbf{6}_1$–$\mathbf{6}_4$, and a current flow at the time the EL elements $E_{1,2}$ and $E_{3,2}$ begin emitting light. The change-over switches $\mathbf{5}_1$ and $\mathbf{5}_3$ connect the current sources $\mathbf{4}_1$ and $\mathbf{4}_3$ to the anode lines $A_1$ and $A_3$, respectively and the change-over switches $\mathbf{5}_2$ and $\mathbf{5}_4$ make the anode lines $A_2$ and $A_4$ equal to the ground potential, respectively. The change-over switch $\mathbf{6}_2$ is selected to make the cathode line $B_2$ equal to the ground potential, and the remaining change-over switches $\mathbf{6}_1$, $\mathbf{6}_3$ and $\mathbf{6}_4$ apply the potential VK to the cathode lines $B_1$, $B_3$ and $B_4$.

In the state of FIG. 8, the current flows from the current source $\mathbf{4}_1$ to the ground through the change-over switch $\mathbf{5}_1$, anode line $A_1$, EL element $E_{1,2}$, cathode line $B_2$ and change-over switch $\mathbf{6}_2$, causing the EL element $E_{1,2}$ to emit light. Similarly, the current flows from the current source $\mathbf{4}_3$ to the ground through the change-over switch $\mathbf{5}_3$, anode line $A_3$, EL element $E_{3,2}$, cathode line $B_2$ and change-over switch $\mathbf{6}_2$, causing the EL element $E_{3,2}$ to emit light.

Also, in the state of FIG. 8, the cathode electrodes of the EL elements $E_{1,1}$–$E_{4,1}$ are applied with the potential VK through the change-over switch $\mathbf{6}_1$ and cathode line $B_1$; the cathode electrodes of the EL elements $E_{1,3}$–$E_{4,3}$ are applied with the potential VK through the change-over switch $\mathbf{6}_3$ and cathode line $B_3$; and the cathode electrodes of the EL elements $E_{1,4}$–$E_{4,4}$ are applied with the potential VK through the change-over switch $\mathbf{6}_4$ and cathode line $B_4$. The anode lines $A_2$ and $A_4$ are connected to the connection line L of the power supply circuit 11, logic circuit 12 and capacitor 13 through the change-over switches $\mathbf{5}_2$ and $\mathbf{5}_4$ and switch 10. Thus, the EL elements $E_{2,1}$, $E_{2,3}$, $E_{2,4}$, $E_{4,1}$, $E_{4,3}$ and $E_{4,4}$ are applied with the voltage VK-VL. In the application, since the cathode electrode side is positive and the anode electrode side is negative, it is in a so-called backward biased state. A current by the voltage VK-VL flows through the EL elements $E_{2,1}$, $E_{2,3}$, $E_{2,4}$, $E_{4,1}$, $E_{4,3}$ and $E_{4,4}$ from the cathode electrode side to the anode electrode side, and then the current flows into the ground through the change-over switches $\mathbf{5}_2$ and $\mathbf{5}_4$, switch 10 and logic circuit 12. The current charges the EL elements $E_{2,1}$, $E_{2,3}$, $E_{2,4}$, $E_{4,1}$, $E_{4,3}$ and $E_{4,4}$ and operates the logic circuit 12. In other words, similar to the time at which the aforementioned EL elements $E_{1,2}$ and $E_{3,2}$ start emitting light, the logic circuit 12 consumes the charging current, so that it is possible to improve the useless power consumption by the charging current flowing directly to the ground in the conventional apparatus. Also, when the EL elements $E_{2,1}$ $E_{2,3}$, $E_{2,4}$, $E_{4,1}$, $E_{4,3}$ and $E_{4,4}$ are fully charged, the current no longer flows.

Figure 9:
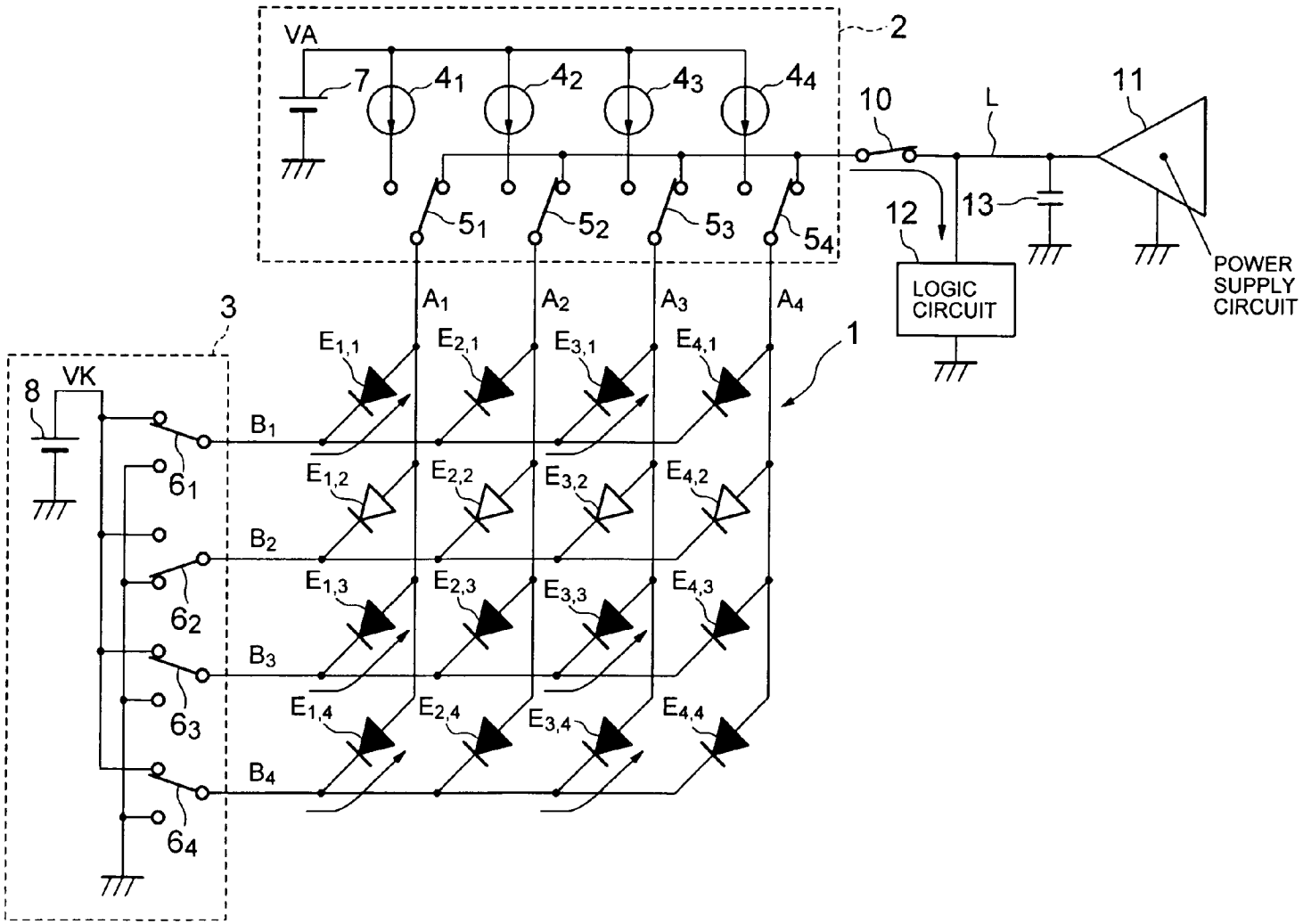
FIG. 9 is a diagram showing the operating state of the change-over switches and a current flow when a light emitting period of the EL elements terminates in the apparatus of FIG. 7.

Upon termination of a light emitting period of the EL elements $E_{1,2}$, and $E_{3,2}$, the change-over switches $\mathbf{5}_1$ and $\mathbf{5}_3$ are switched, as shown in FIG. 9, to connect the anode lines $A_1$ and $A_3$ to the connection line L of the power supply circuit 11, logic circuit 12 and capacitor 13 through the switch 10. At this time, the change-over switch $\mathbf{6}_2$ still maintains the cathode line $B_2$ to be equal to the ground potential. Therefore, the cathode electrodes of the EL elements $E_{1,2}$, $E_{2,2}$, $E_{3,2}$ and $E_{4,2}$ are at the ground potential and the anode electrodes at the potential VL, resulting in application of a voltage lower than a minimum light emission voltage, so that the EL elements $E_{1,2}$ and $E_{3,2}$ stop emitting light. On the other hand, the EL elements $E_{1,1}$, $E_{1,3}$, $E_{1,4}$, $E_{3,1}$, $E_{3,3}$ and $E_{3,4}$ are applied with the voltage VK-VL. In the application, since the cathode electrode side is positive and the anode electrode side is negative, it is in a so-called backward biased state. A current by the voltage VK-VL flows through the EL elements $E_{1,1}$, $E_{1,3}$, $E_{1,4}$, $E_{3,1}$, $E_{3,3}$ and $E_{3,4}$ from the cathode electrode side to the anode electrode side, and the current flows into the ground through the change-over switches $\mathbf{5}_1$ and $\mathbf{5}_3$, switch 10 and logic circuit 12. The current charges EL elements $E_{1,1}$, $E_{1,3}$, $E_{1,4}$, $E_{3,1}$, $E_{3,3}$ and $E_{3,4}$ and operates the logic circuit 12. In other words, the logic circuit 12 consumes the charging current, so that it is possible to improve the useless power consumption by the charging current flowing directly to the ground in the conventional apparatus. Also, when the EL element $E_{1,1}$, $E_{1,3}$, $E_{1,4}$, $E_{3,1}$, $E_{3,3}$ and $E_{3,4}$ are fully charged, the current no longer flows.

Charges accumulated on EL elements except for the EL elements $E_{1,2}$, $E_{2,2}$, $E_{3,2}$ and $E_{4,2}$ by the charging are discharged by a reset operation, immediately before the selection signal is generated for the next scanning, which forcedly connects all the cathode lines $B_1$–$B_4$ to the ground and applies a predetermined potential to the anode lines $A_1$–$A_4$.

The charging and discharging operations are similar when any one of other change-over switches $\mathbf{6}_1$, $\mathbf{6}_3$, $\mathbf{6}_4$ is selected by scanning to supply the ground potential to the corresponding cathode line.

Figure 10:
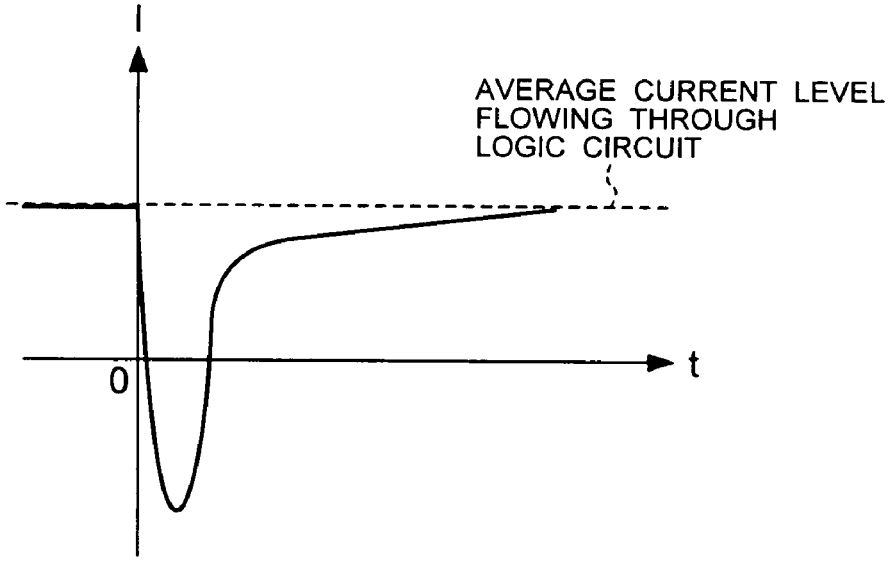
FIG. 10 is a diagram showing a change in a current flowing into charged EL elements over time in the apparatus of FIG. 7.

The current flowing from the power supply circuit 11 to the logic circuit 12 changes, for example, as shown in FIG. 10, by the current flowing from the display panel 1 to the logic circuit 12 as described above. In FIG. 10, a time t=0 is the time at which the state in the aforementioned FIG. 8 or FIG. 9 is obtained.

In the foregoing embodiment, the capacitor 13 is connected to the output of the power supply circuit 11 for smoothing. The external connection of the capacitor 13 is not needed when a capacitor is contained in the power supply circuit 11 for smoothing.

Figure 11:
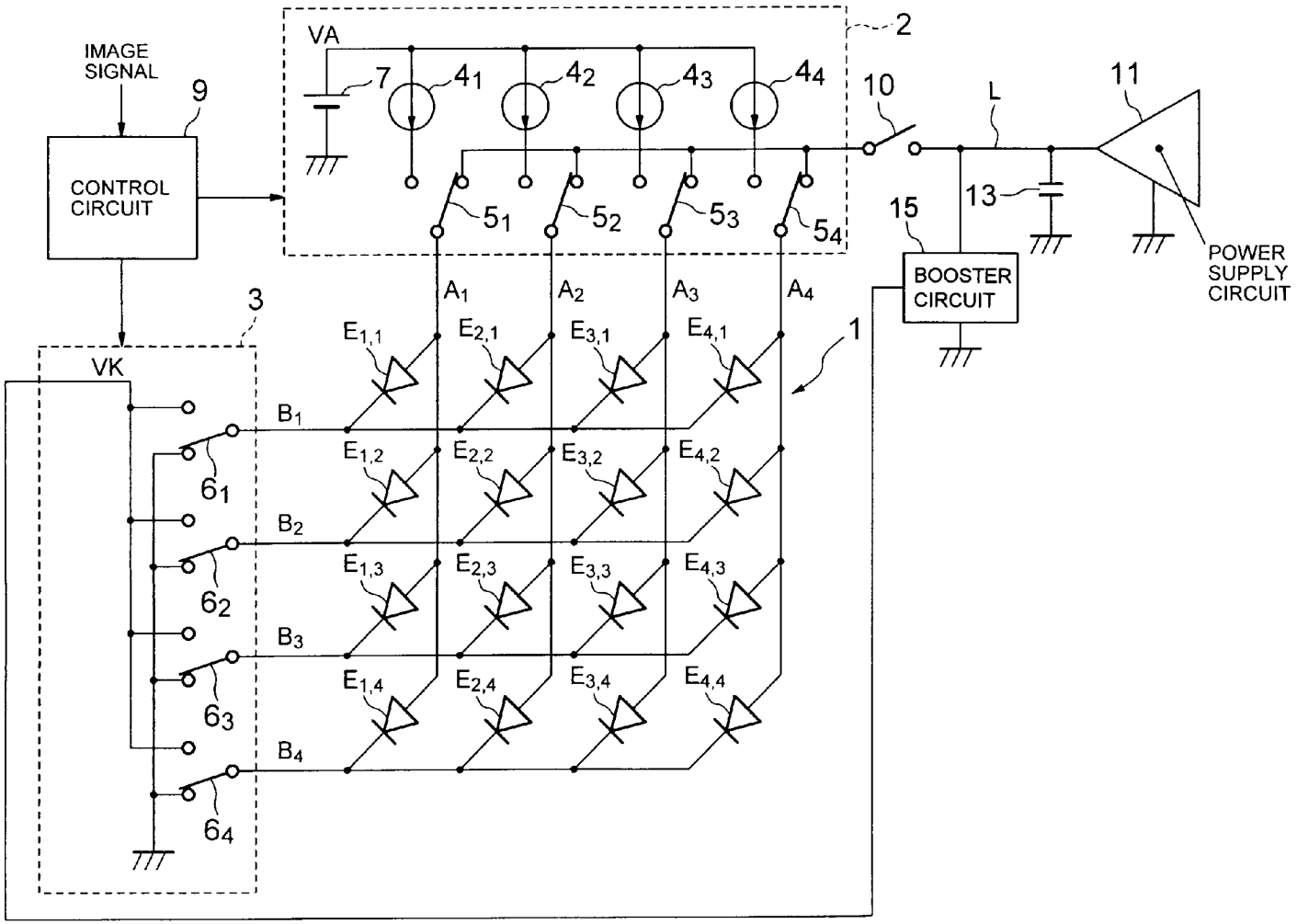
FIG. 11 is a diagram showing another embodiment of the present invention.

Also, in the foregoing embodiment, the charging current is supplied to the logic circuit 12. However, the charging current may be supplied to a booster circuit 15 as shown in FIG. 11. Here, the power supply circuit 11 is a power supply circuit for the booster circuit 15. Further, the aforementioned voltage VK of the power supply 8 may be obtained by a voltage boosted by the booster circuit 15. In other words, with the power supply 8 as a battery, the battery can be charged by the voltage boosted by the booster circuit 15.

Figure 12:
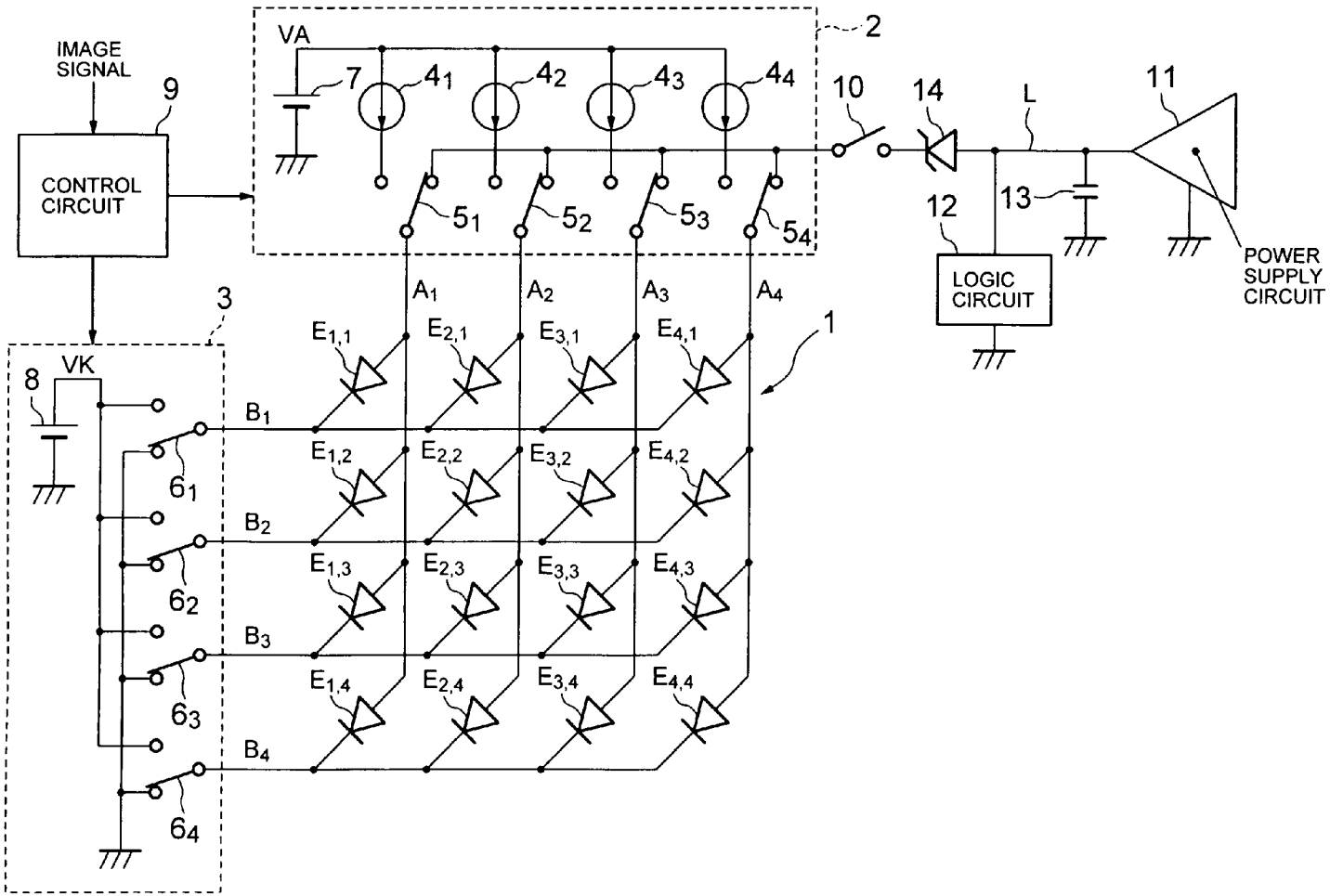
FIG. 12 is a diagram showing another embodiment of the present invention.
Figure 13:
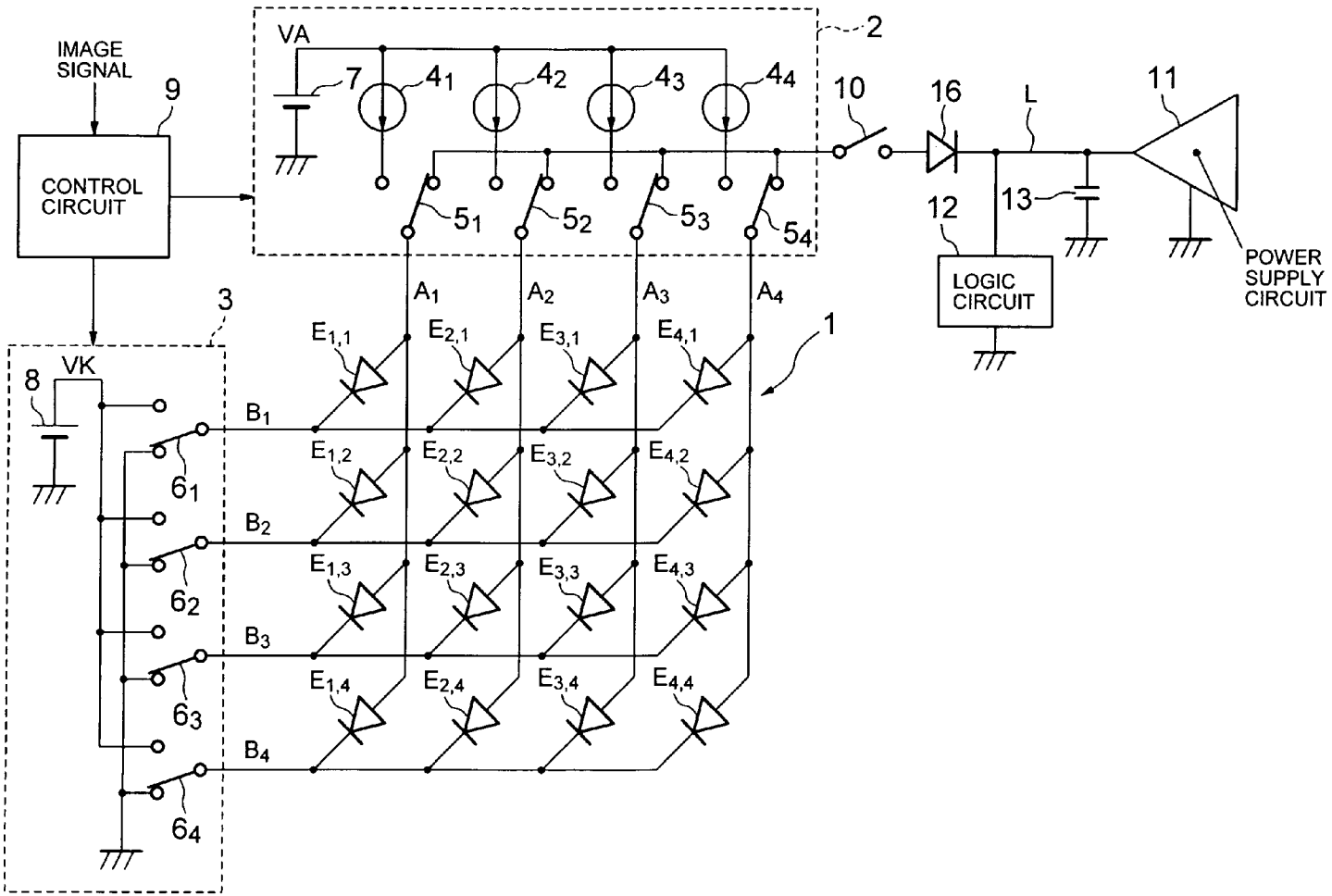
FIG. 13 is a diagram showing another embodiment of the present invention.

Also, as shown in FIG. 12, a zener diode 14 may be inserted between the switch 10 and the logic circuit 12. The zener diode 14 is provided for adjusting a potential difference between a potential on the logic circuit 12 and a potential on the display panel 1, i.e., a voltage applied to EL elements in backward bias. Further, as shown in FIG. 13, a diode 16 may be inserted for preventing a current from flowing from the logic circuit 12 to the display panel 1.

As described above, according to the present invention, it is possible to reduce useless power consumption by a charging current of capacitive light emitting elements of a display panel.

This application is based on a Japanese Patent Application No. 2001-236619 which is hereby incorporated by reference.

What is claimed is:

1. A driving apparatus for a display panel including a plurality of drive lines and a plurality of scanning lines intersecting with said plurality of drive lines, a plurality of capacitive light emitting elements connected between said scanning lines and said drive lines at each of a plurality of intersecting positions by said drive lines and said scanning lines and having polarities, said driving apparatus comprising:

a controller for selecting one scanning line of said plurality of scanning lines in order at a predetermined timing to specify as a light emission drive line a drive line corresponding to a capacitive light emitting element driven to emit light on said one scanning line, of said plurality of drive lines;

a scanning device for supplying said one scanning line with a first predetermined potential, and supplying scanning lines other than said one scanning lines of said plurality of scanning lines with a second predetermined potential higher than said first predetermined potential; and a driver for supplying said light emission drive line with a driving current to apply said capacitive light emitting element driven to emit light with a positive voltage equal to or higher than a light emission threshold voltage in a forward direction and supplying drive lines other than said light emission drive lines of said plurality of drive lines with a third predetermined potential higher than said first predetermined potential and lower than said light emission threshold voltage, wherein said third predetermined potential is generated from a current discharge terminal of a voltage source connected to a predetermined load circuit for supplying a power supply voltage to said predetermined load circuit.

2. A driving apparatus according to claim 1, wherein said predetermined load circuit is a logic circuit, and said voltage source is a power supply circuit for said logic circuit.

3. A driving apparatus according to claim 1, wherein said predetermined load circuit is a booster circuit, and said voltage source is a power supply circuit for said booster circuit.

4. A driving apparatus according to claim 1, wherein a capacitor having a capacitance larger than a capacitance of said display panel is connected between said current discharge terminal and a ground.

5. A driving apparatus according to claim 1, wherein said voltage source outputs a voltage lower than a light emission threshold voltage of each of said plurality of capacitive light emitting elements.

6. A driving apparatus according to claim 1, wherein a zener diode is inserted between said current discharge terminal and said driver so as to adjust a potential difference.

7. A driving apparatus according to claim 1, wherein a diode is inserted between said current discharge terminal and said driver so as to prevent a current from flowing in a reverse direction.

* * * * *